US006435822B1

(12) United States Patent
Kobayashi et al.

(10) Patent No.: US 6,435,822 B1
(45) **Date of Patent: *Aug. 20, 2002**

(54) LABYRINTH SEALING DEVICE, AND FLUID MACHINE PROVIDING THE SAME

(75) Inventors: Hiromi Kobayashi; Hideo Nishida; Haruo Miura, all of Ibaraki-ken; Takashi Eino, Tsuchiura; Kazuki Takahashi, Ibaraki-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/864,148

(22) Filed: May 25, 2001

Related U.S. Application Data

(60) Continuation of application No. 09/505,191, filed on Feb. 16, 2000, now Pat. No. 6,302,645, which is a division of application No. 09/102,562, filed on Jun. 23, 1998, now Pat. No. 6,039,535.

(30) Foreign Application Priority Data

Jun. 23, 1997 (JP) ..... 9-165617

(51) Int. Cl.[7] ..... F04D 29/08; F04D 29/10; F04D 29/16

(52) U.S. Cl. ..... 415/172.1; 415/173.4; 415/173.5; 415/174.4; 415/174.5; 415/230

(58) Field of Search ..... 415/172.1, 173.4, 415/173.5, 174.4, 174.5, 230; 277/411, 412, 415, 421

(56) References Cited

U.S. PATENT DOCUMENTS

| | | | | |
|---|---|---|---|---|
| 3,066,912 A | * | 12/1962 | Scheper, Jr. | 415/169.1 |
| 3,092,306 A | * | 6/1963 | Eder | 277/415 |
| 3,339,933 A | * | 9/1967 | Foster | 415/174.4 |
| 3,723,165 A | * | 3/1973 | Longo et al. | 117/93.1 |

(List continued on next page.)

FOREIGN PATENT DOCUMENTS

| | | | | |
|---|---|---|---|---|
| JP | 53-64107 | * | 6/1978 | 415/174.5 |
| JP | 3-295499 | * | 12/1991 | 415/174.5 |
| JP | 4-203565 | | 7/1992 | |
| JP | 7-217595 | | 8/1995 | |
| SU | 385114 | * | 5/1973 | 277/412 |
| SU | 1513157 | * | 10/1989 | 415/174.5 |

OTHER PUBLICATIONS

Development of High–Speed High–Performance Compressor, Mitsubishi Heavy Industries Technical Review, vol. 23, No. 5 (1986–9), 7 pages.

Modifying Compressors at Ethylene Plant for Increasing Capacity and Saving Energy; Proceedings of Ebara, No. 154 (1992–1), 7 pages.

*Primary Examiner*—Christopher Verdier
(74) *Attorney, Agent, or Firm*—Crowell & Moring LLP

(57) ABSTRACT

In a fluid machine such as multistage centrifugal compressor, the pressure of a working fluid is raised with the rotation of a impeller. A shaft sealing device is mounted at the end of the rotary shaft in order to prevent the working gas of the raised pressure from leaking out of the fluid machine and then polluting the surroundings. In a case where the fluid machine operates to rotate at high speed, a labyrinth sealing device is employed for the purpose of reducing a frictional loss in the shaft sealing device. The labyrinth sealing device includes a plurality of stages of labyrinth fins which are formed on a casing or the rotary shaft, and a layer of abradable coating to-be-bitten which is formed in the surface part of the rotary shaft or the casing opposing to the labyrinth fins. The clearances between the labyrinth fins and the rotary shaft or the casing are made narrower on the low-pressure side of the labyrinth sealing device than on the high-pressure side thereof. Thus, the fluid machine is run with the minimum clearance. Moreover, even when the coating layer has been lost in touch with the labyrinth fin or by peeling off, the labyrinth fin on the low-pressure side acts as a labyrinth seal.

4 Claims, 6 Drawing Sheets

U.S. PATENT DOCUMENTS 4,057,362 A * 11/1977 Schwaebel ..... 415/174.5
4,060,250 A * 11/1977 Davis et al. ..... 277/415
4,155,681 A * 5/1979 Linko, III et al. ..... 415/121.2
4,405,284 A * 9/1983 Albrecht et al. ..... 415/173.4
4,909,706 A * 3/1990 Bergsten et al. ..... 277/412
4,978,278 A * 12/1990 Kun ..... 415/172.1
4,999,225 A * 3/1991 Rotolico et al. ..... 427/423
5,126,205 A * 6/1992 Chon et al. ..... 428/405
5,153,021 A * 10/1992 Litchfield et al. ..... 427/447
5,211,535 A * 5/1993 Martin et al. ..... 415/174.4
5,271,712 A * 12/1993 Brandon ..... 415/121.2
5,599,026 A * 2/1997 Sanders et al. ..... 277/415
5,890,873 A * 4/1999 Willey ..... 415/173.5
6,039,535 A * 3/2000 Kobayashi ..... 415/172.1
6,302,645 B1 * 10/2001 Kobayashi ..... 415/172.1

* cited by examiner

LABYRINTH SEALING DEVICE, AND FLUID MACHINE PROVIDING THE SAME

This application claims the priority of Japanese application 9-165617, filed Jun. 23, 1997, the disclosure of which is expressly incorporated by reference herein. This application is a continuation of application Ser. No. 09/505,191, filed Feb. 16, 2000, now U.S. Pat. No. 6,302,645, issued Oct. 16, 2001, which in turn is a divisional of application Ser. No. 09/102,562, filed Jun. 23, 1998, now U.S. Pat. No. 6,039, 535, issued Mar. 21, 2000.

BACKGROUND OF THE INVENTION

The present invention relates to a sealing device which prevents the leakage flow between a rotating element and a stationary member, and a fluid machine which provides the sealing device.

As has the vertical sectional view of its upper half part illustrated in FIG. 7, a multistage centrifugal compressor being one example of a multistage type fluid machine operates so that a working gas 10 drawn through an intake pipe 7 is compressed and then discharged out of the machine through a delivery pipe 8 as a plurality of stages of impellers 6 (6*a*~6*f*) mounted on a rotary shaft 1 rotate. More specifically, after the working gas 10 has flowed in through the intake pipe 7, its pressure is raised by the impellers 6 at the respective stages. Subsequently, pressure recovery is achieved in passing through diffusers 13 (13*a*~13*f*) and return channels 14 (14*a*~14*e*) disposed at the respective stages, whereupon it passes to the delivery pipe 8. Labyrinth seals 11 and 12 are installed between the rotary shaft 1 as well as the impellers 6 and a stationary side casing 9. These labyrinth seals include the labyrinth seals 11 fitted at parts at which the working gas 10 returns from the outlet sides of the respective impellers 6 to the inlet sides thereof, in other words, which are near the inlets of the respective impellers 6 (hereinbelow, the labyrinth seals 11 shall be termed the "inlet labyrinth seals"), and the labyrinth seals 12 fitted between the respectively adjacent two compressor stages (hereinbelow, the labyrinth seals 12 shall be termed the "interstage labyrinth seals"). Further, a labyrinth seal 15 is used at the part of a balance drum.

FIG. 8 illustrates the details of the labyrinth seals which have heretofore been employed in the multistage centrifugal compressor shown in FIG. 7. Referring to FIG. 8, each of the labyrinth seals forms cylindrical sealing surfaces which are parallel to the rotary shaft 1. Also, either the rotating side member or the stationary side member (here in the illustration of FIG. 8, the stationary side member) is provided with a plurality of fins 2 corresponding to each labyrinth seal, and the gaps between the distal ends of the fins 2 and the opposing surface are narrowed, thereby suppressing the corresponding one of leakage streams 5*a* and 5*b* of the working gas 10 from the high-pressure side of the entire labyrinth sealing device.

Examples wherein such labyrinth seals are disposed, are stated in the official gazettes of Japanese Patent Applications Laid-open No. 217595/1995 and No. 203565/1992. The example in No. 217595/1995 is intended to reduce the rate of leakage flow in such a way that a stationary side member is provided with fins, the distal ends of which are subjected to gap-forming coating (hereinbelow, the gap-forming coating shall be termed the "abradable coating") to-be-bitten, thereby reducing the clearance between the stationary side member and a rotating side member. On the other hand, the example in No. 203565/1992 is intended to reduce the rate of leakage flow in such a way that a rotating side member is provided with fins, while a stationary side member is subjected to abradable coating to-be-bitten, thereby to reduce the clearance between both the members.

Examples in each of which the parts of a stationary side member corresponding to the inlet parts of impellers are similarly subjected to abradable coating to-be-bitten with the intention of reducing the rate of leakage flow, are also reported in Mitsubishi Heavy Industries Technical Review, Vol. 23, No. 5 (1986-9), and Proceedings of Ebara, No. 154 (1992-1).

The labyrinth sealing device in the prior art is so designed that the fins provided on the stationary side member do not touch the rotating side member in principle, but define the gaps with respect to the rotating side member without fail. With this device, therefore, the reduction of the clearance between both the members is limited. By way of example, in a case where the flow rate of the leakage streams 5*a* and 5*b* is small relative to the flow rate of the mainstream 10 in the illustration of FIG. 8, the performance of the fluid machine is little affected by these leakage streams. However, at the low specific speed stage, the operating efficiency of the fluid machine is drastically reduced due to the large leakage flow rate. Moreover, when the clearance is made excessively small in the known labyrinth sealing device, it is apprehended in the case of, for example, the compressor that unstable vibrations ascribable to the rotating stall or to surge will arise to damage the rotating shaft 1 on account of being touched by the labyrinth fins.

On the other hand, regarding the technique stated in the official gazette of Japanese Patent Application Laid-open No. 217595/1995 or No. 203565/1992 wherein, in order to enhance a sealing effect, the smallest possible clearance is defined between sealing surfaces, one of which is subjected to the abradable coating to-be-bitten, it is apprehended that the layer of the abradable coating to-be-bitten will degrade and will fail to demonstrate an expected performance over a long term. More specifically, when the technique is applied to a processing compressor or the like which is treated with various kinds of gases, the material of the coating degrades due to any corrosive gas. Thereafter, when the fluid instability phenomenon such as the surging or the rotating stall has taken place, the vibrations of a shaft increase to bring the fins and the coating surface into contact. As a result, the coating material might peel off. In this case, the performance of the fluid machine is drastically lowered. Another drawback is that the reliability of the fluid machine decrease.

SUMMARY OF THE INVENTION

The present invention has been made in view of the recognition of the disadvantages involved in the prior-art techniques, and it has for its object to provide a labyrinth sealing device which can keep a stable performance over a long term, and a fluid machine which employs the labyrinth sealing device.

Another object of the present invention is to provide a labyrinth sealing device which experiences only a slight leakage loss and exhibits a high reliability even when a coating material has damaged or peeled off due to corrosion or the like, and a fluid machine which employs the labyrinth sealing device.

Still another object of the present invention is to provide a labyrinth sealing device which does not spoil the performance of conventional labyrinth fins and exhibits a long lifetime, and a fluid machine which employs the labyrinth sealing device.

The first feature of the present invention for accomplishing the above objects resides in a fluid machine having a rotary shaft, at least one centrifugal impeller which is mounted on the rotary shaft, and a casing which is arranged so as to cover up the centrifugal impeller; wherein at least either of said rotary shaft and said centrifugal impeller is provided with a plurality of first fins, and a plurality of second fins which are spaced from the first fins in an axial direction of the fluid machine, wherein a part of the casing as opposes to said first fins is subjected to abradable coating to-be-bitten, and wherein a clearance which is defined between said casing and said first fins is set smaller than a clearance which is defined between said casing and the second fins.

The second feature of the present invention for accomplishing the above objects resides in a fluid machine having a rotary shaft, at least one centrifugal impeller which is mounted on the rotary shaft, and a casing which is arranged so as to cover up the centrifugal impeller; wherein at least either of said rotary shaft and said centrifugal impeller is provided with a plurality of first fins, while the casing is provided with a plurality of second fins, wherein said casing is subjected to abradable coating to-be-bitten at its position opposing to the first fins, and wherein a clearance which is defined between said first fins and said casing is set smaller than a clearance which is defined between the second fins and either of said rotary shaft and said centrifugal impeller.

Besides, it has now been recognized to be favorable in the fluid machine that each of the labyrinth fins is perpendicular to said rotary shaft and is continuous in a circumferential direction thereof; that each of the labyrinth fins is wider at its base than at its distal end; that said first fins are disposed in those two places in an axial direction of said rotary shaft between which said second fins are held, while said casing is formed with a groove being continuous in a circumferential direction thereof, in its part between said first fins and said second fins; or that the abradable coating to-be-bitten is thermal spraying of a nickel-graphite-based coating material, thermal spraying of an aluminum-silicon-polyester-based coating material, or coating with white metal.

The third feature of the invention for accomplishing the above objects resides in a labyrinth sealing device having a rotary shaft and a stationary casing, either of which is provided with a plurality of labyrinth fins; wherein a clearance which at least one of the labyrinth fins defines with respect to its opposing part of either of the rotary shaft and the stationary casing is set smaller than a clearance which any other labyrinth fin defines, and wherein said either of said rotary shaft and said stationary casing is subjected to abradable coating to-be-bitten at its part opposing to the labyrinth fin of the smaller clearance.

Favorably, a plurality of labyrinth fins which oppose the part subjected to the abradable coating to-be-bitten are provided, and heights of the plurality of labyrinth fins are successively changed from a high-pressure side of said labyrinth sealing device toward a low-pressure side thereof.

The fourth feature of the present invention for accomplishing the above objects resides in a labyrinth sealing device having an impeller and a casing, either of which is provided with a plurality of labyrinth fins; wherein a clearance which at least one of the labyrinth fins defines with respect to its opposing part of either of the impeller and the casing is set smaller than a clearance which any other labyrinth fin defines, and wherein said either of said impeller and said casing is subjected to abradable coating to-be-bitten at its part opposing to the labyrinth fin of the smaller clearance.

Also, it has been found desirable in the labyrinth sealing device that each of the labyrinth fins is perpendicular to said rotary shaft and is continuous in a circumferential direction thereof; that each of the labyrinth fins is wider at its base than at its distal end; or that the abradable coating to-be-bitten is flame spraying of a nickel-graphite-based coating material, flame spraying of an aluminum-silicon-polyester-based coating material, or coating with white metal.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
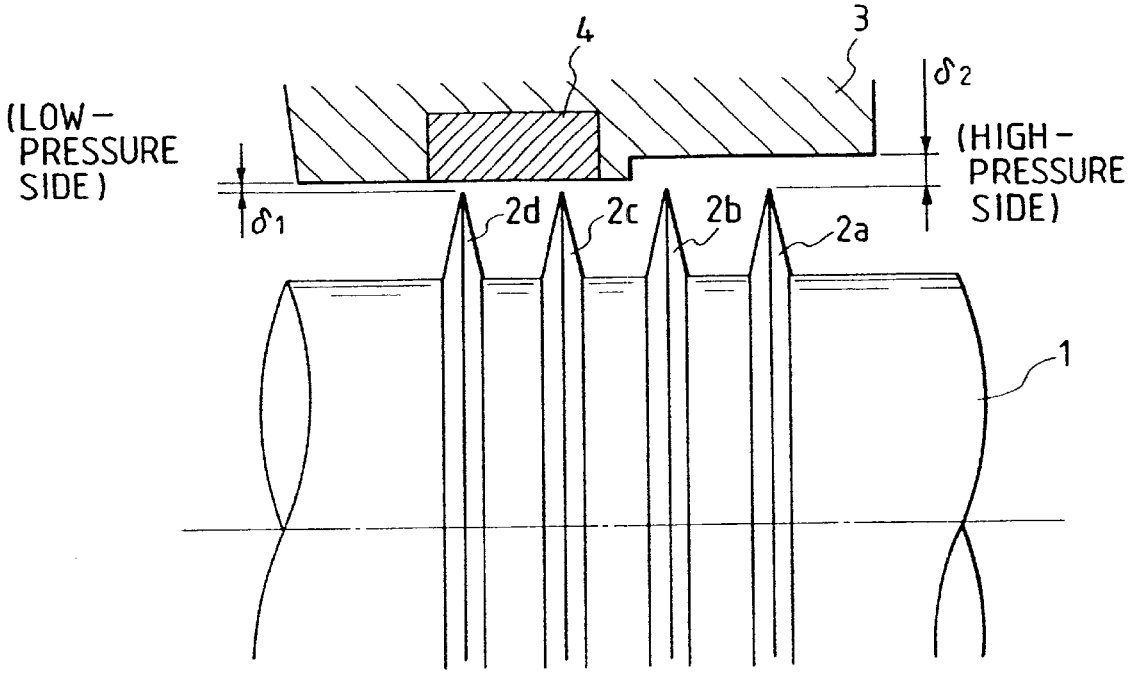
FIG. 1 is a vertical sectional view of an embodiment of a labyrinth sealing device according to the present invention, showing a stationary state of a fluid machine.
Figure 2:
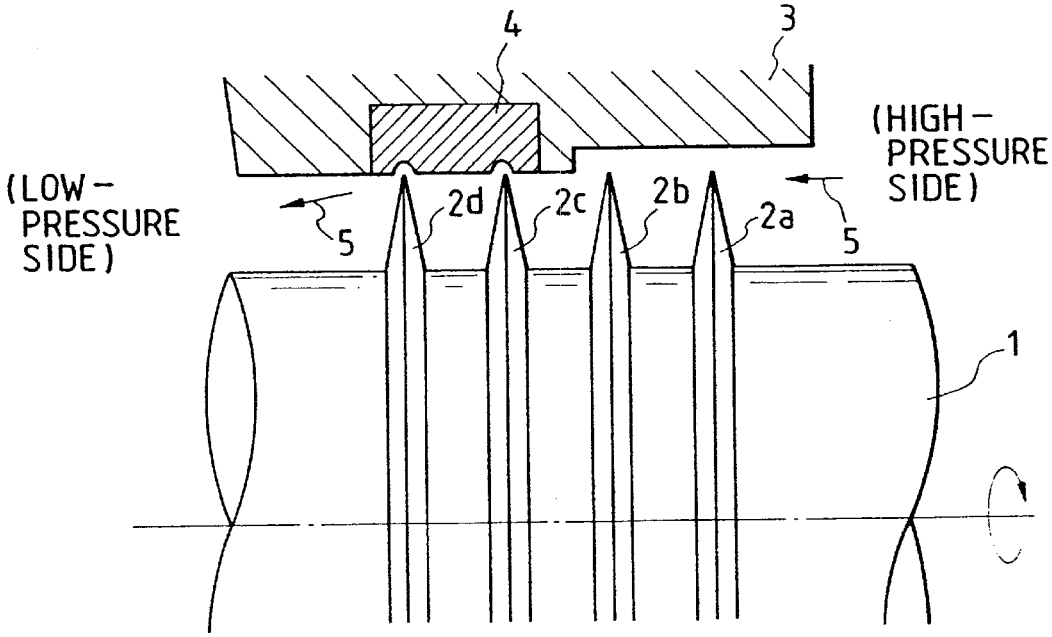
FIG. 2 is a vertical sectional view of the embodiment of the labyrinth sealing device according to the present invention, showing a running state of the fluid machine.

The labyrinth sealing device of FIGS. 1–6 is formed as a shaft sealing device in order to lessen a leakage stream 5 which flows through between a rotary shaft 1 and a stationary casing 3. FIG. 1 illustrates a state where the centrifugal compressor has not yet started to rotate, namely, the stationary state of the compressor, while FIG. 2 illustrates a state where the rotary shaft 1 of the compressor is rotating. In the embodiment shown in both the figures, the rotary shaft 1 is provided with fins 2*a*~2*d* which constitute the labyrinth sealing device. In addition, the diameters df of the distal ends of all the fins 2*a*~2*d* are equal. The inner casing 3 opposing to the fins 2*a*~2*d* is formed with a stepped structure in the axial direction of the compressor. The stepped structure is so set that distal-end gaps being the distances between the fins 2*a*~2*d* and the inner casing 3 become large at the upstream part (on the high-pressure side) of the leakage stream 5 and small at the downstream part (on the low-pressure side) thereof. That is, the distal-end gaps $\delta_1$ of the fins 2*c*, 2*d* are smaller than those $\delta_2$ of the fins 2*a*, 2*b*. Moreover, that part of the inner casing 3 which opposes the distal ends of the fins 2*c*, 2*d* is formed with a layer of abradable coating to-be-bitten 4. Needless to say, such a coating layer may well be prepared on the surface of a separate member, which is arranged so as to define a predetermined spacing from the fins.

The multistage centrifugal compressor is so designed that a slight clearance is defined between the layer of abradable coating to-be-bitten 4 and the distal ends of the fins 2*c*, 2*d* in the stationary state of the compressor, in other words, in the assembled state thereof. Also, the compressor is so designed that, when the fin portion has been outstretched in the radial direction of this compressor by centrifugal force of the rotary shaft 1, the distal ends of the fins 2*c*, 2*d* come into touch with the coating layer 4. Thus, when the distal ends of the fins 2*c*, 2*d* have touched the coating layer 4, the surface of this coating layer is slightly bitten off. As a result, the distal-end gaps of the fins 2*c*, 2*d* can be made as small as possible, during the rotation of the rotary shaft 1.

The fins 2*a*, 2*b* on the high-pressure side are also stretched radially outwards by centrifugal force of the rotary shaft 1. Accordingly, the distance between the distal ends of the fins 2*a*, 2*b* and the inner casing 3 becomes shorter in the running state of the compressor than in the stationary state thereof. The distal ends of the fins 2*a*, 2*b* and the inner casing 3, however, have the clearance between them set so as not to come into touch even when the rotary shaft 1 rotates. In this embodiment, the distal-end gaps of the fins 2*a*, 2*b* are made larger than in case of employing conventional non-touching seals, for example, labyrinth seals or screw seals. Thus, the fins 2*a*, 2*b* and the inner casing 3 opposing thereto do not touch during the ordinary running of the compressor, so that the material of the inner casing 3 can be selected without considering contact between the rotary shaft 1 and the casing 3.

In this embodiment thus far described, the sealing fins include the fins 2*c*, 2*d* of the type which defines the minimum clearance upon touching the opposing surface during the running of the compressor, and the fins 2*a*, 2*b* of the type which fundamentally keeps a predetermined clearance without touching the opposing surface. Since the rate of leakage flow is determined by the minimum clearance in most cases, the fins which define the minimum clearance between them and the layer of abradable coating to-be-bitten, just like the fins 2*c*, 2*d*, need not be disposed in large numbers. The labyrinth sealing device of this embodiment thus constructed can reduce the rate of leakage flow sufficiently as compared with the labyrinth sealing device which does not include the abradable coating to-be-bitten.

Figure 7:
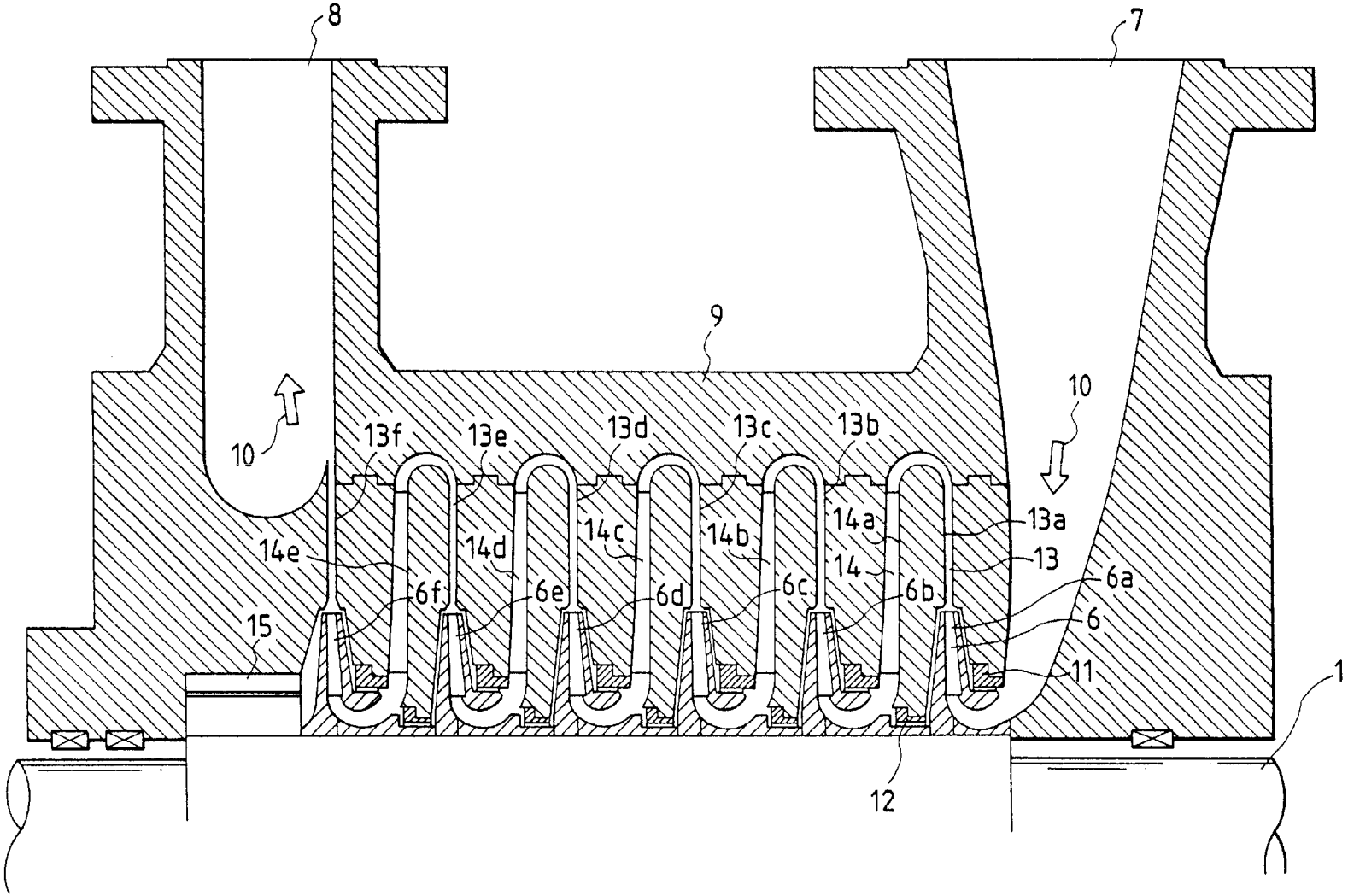
FIG. 7 is a vertical sectional view showing the upper half of an embodiment of a multistage centrifugal compressor.
Figure 8:
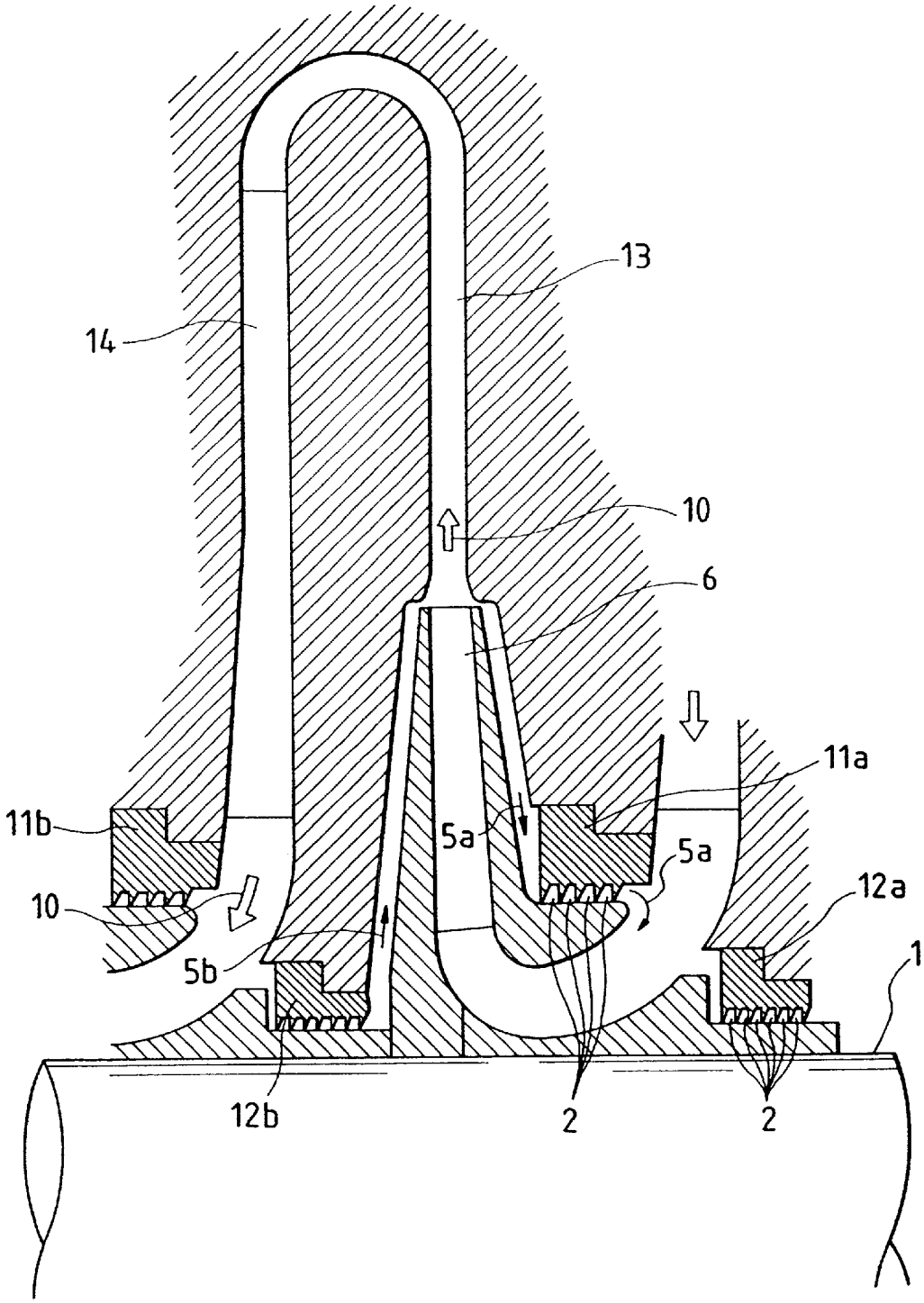
FIG. 8 PRIOR ART
FIG. 8 is a partial vertical sectional view of a multistage centrifugal compressor which employs a labyrinth sealing device in the prior art.

Moreover, even if the portion of the abradable coating to-be-bitten 4 should degrade or peel off due to any trouble or the long-term use of the compressor under a corrosive environment, leakage streams could be suppressed to some extent by the non-contacting fins 2*a*, 2*b*. It is accordingly possible to run the compressor without drastically lowering the performance thereof, and to provide the labyrinth sealing device of very high reliability. Although this labyrinth sealing device is applicable to any of the labyrinth sealing portions of the multistage compressor shown in FIG. 7, it is especially suitable for the balance piston portion.

Incidentally, the surface of the casing 3 opposing the fins is sometimes constructed so that the fins 2*a*, 2*b* may not be damaged even when the opposing surface has come into touch with these fins 2*a*, 2*b* due to the vibration of the rotary shaft 1 exceeding a supposed value. More specifically, in a case where the opposing surface is made of a material softer than the material of the fins, the distal-end clearance $\delta_2$ of the casing part opposing to the fins 2*a*, 2*b* may well be set at the same extent of clearance as in the conventional fins of the non-contacting type.

Figure 3:
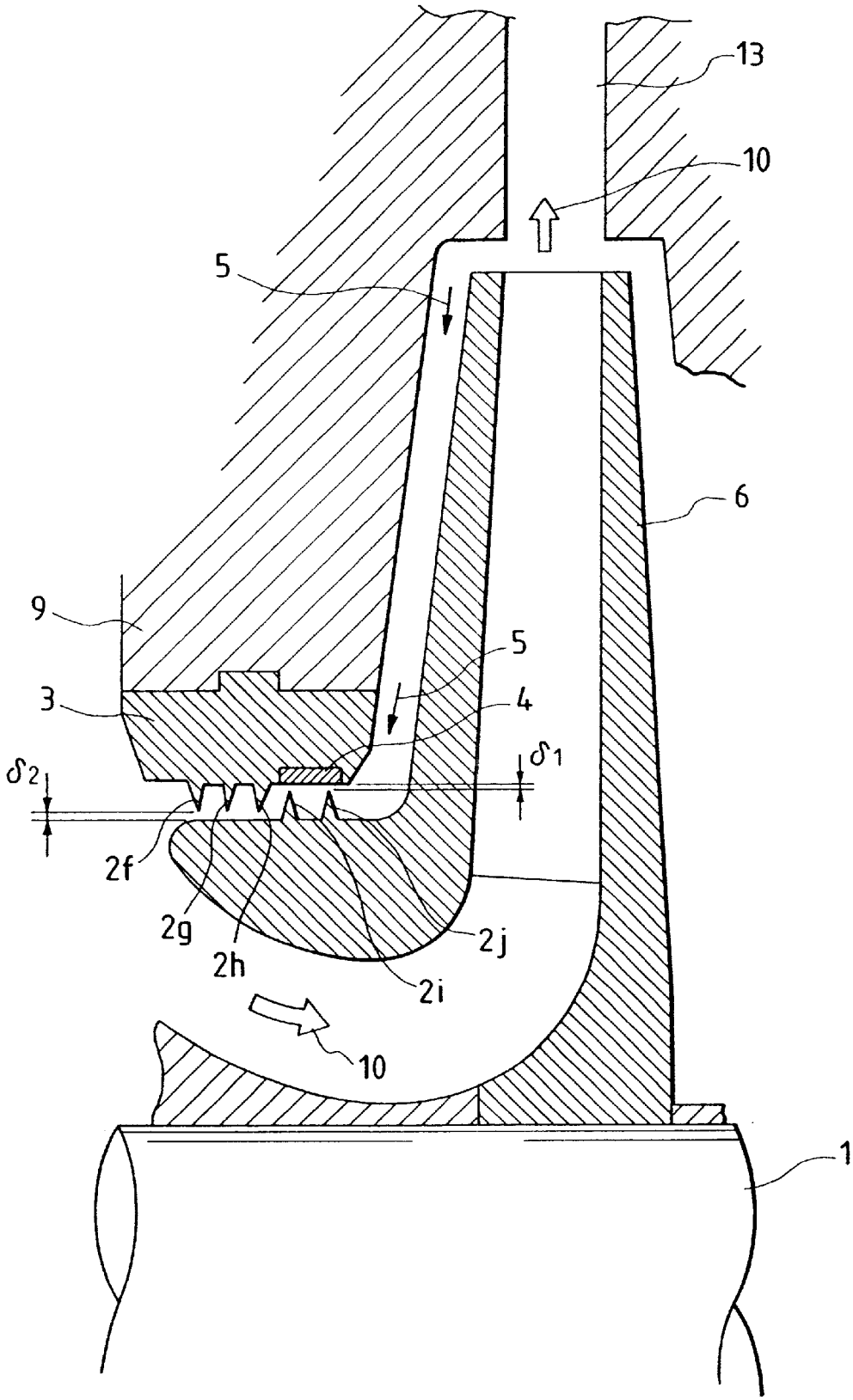
FIG. 3 is a partial detailed vertical sectional view of an embodiment of a multistage centrifugal compressor according to the present invention.

FIG. 3 is the view showing a labyrinth seal according to the present invention applied to the inlet labyrinth of the impeller 6 of a centrifugal fluid machine. The fluid machine is a centrifugal compressor or a centrifugal pump. The main stream 10 of a fluid whose pressure has been raised by the impeller 6 leaves this impeller 6, and thereafter flows into a diffuser 13 which lies outwards of the impeller 6 in the radial direction of the fluid machine. On this occasion, part of the fluid becomes a leakage stream 5, which flows through an interspace or channel defined between the impeller 6 and a casing 9, and then flows toward the inlet side of the impeller 6.

Herein, the inlet (suction port) part of the side plate of the impeller 6 is formed with fins 2*i*, 2*j*. On the other hand, an inner casing 3 is attached to the inner circumferential side of the casing 9, and that surface of the inner casing 3 which opposes to the fins 2*i*, 2*j* is subjected to abradable coating to-be-bitten 4. In addition, that inner circumferential surface of the inner casing 3 which is still closer to the inlet side of the impeller 6 is formed with fins 2*f*, 2*g*, 2*h*. Distal-end gaps $\delta_1$ defined between the fins 2*i*, 2*j* and the layer of abradable coating to-be-bitten 4 is smaller than distal-end gaps $\delta_2$ defined between the fins 2*f*, 2*g*, 2*h* and the inner casing 3. Accordingly, when the impeller 6 is rotated, the fins 2*i*, 2*j* are radially stretched to come into contact with the layer of abradable coating to-be-bitten 4, and the minimum clearance is defined here.

Moreover, in this embodiment, the fins 2*f*, 2*g*, 2*h* are opposite in a sense to the fins 2*i*, 2*j*. Thus, a so-called "through stream" is prevented, so that a still higher sealing effect is attained.

Meanwhile, a material of high strength is used for the impeller 6 in consideration of a centrifugal force acting on this impeller, and precision working such as of the fins requires a large number of man-hour. In this embodiment, in a case where the smallest necessary number of fins are formed on the side of the impeller 6 and where the remaining fins are formed on the side of the inner casing 3 which can be fabricated of a material of good workability, the manufacture of the labyrinth sealing device is economical, and a working precision is easily maintained.

Figure 4:
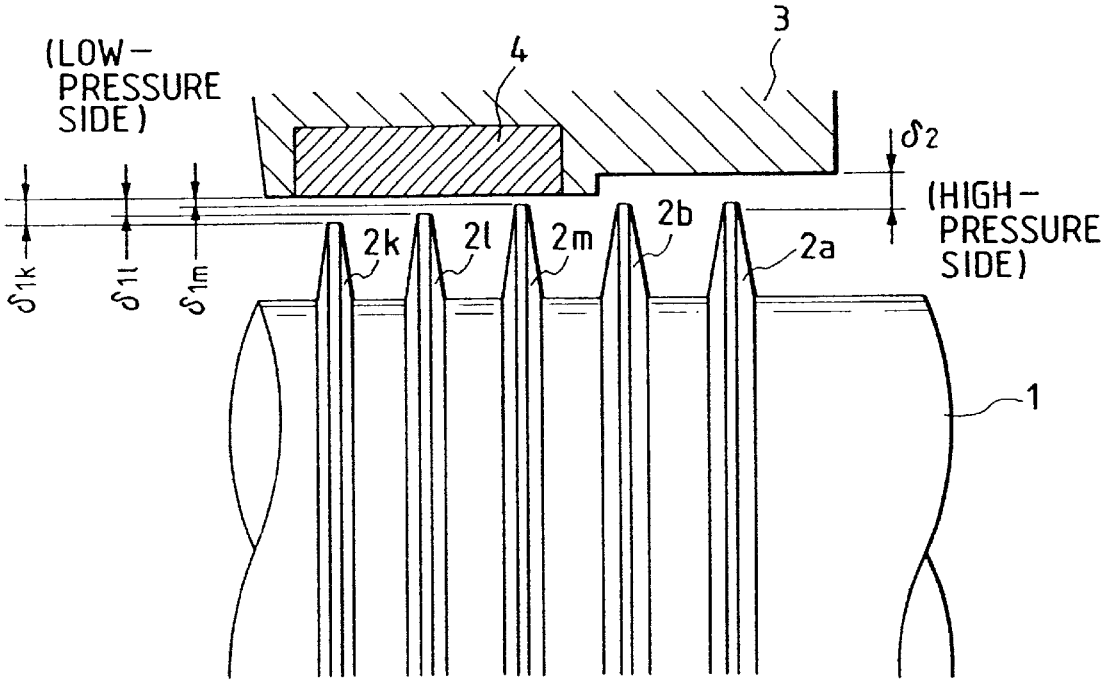
FIG. 4 is a vertical sectional view of another embodiment of a labyrinth sealing device according to the present invention, showing the stationary state of a fluid machine.
Figure 5:
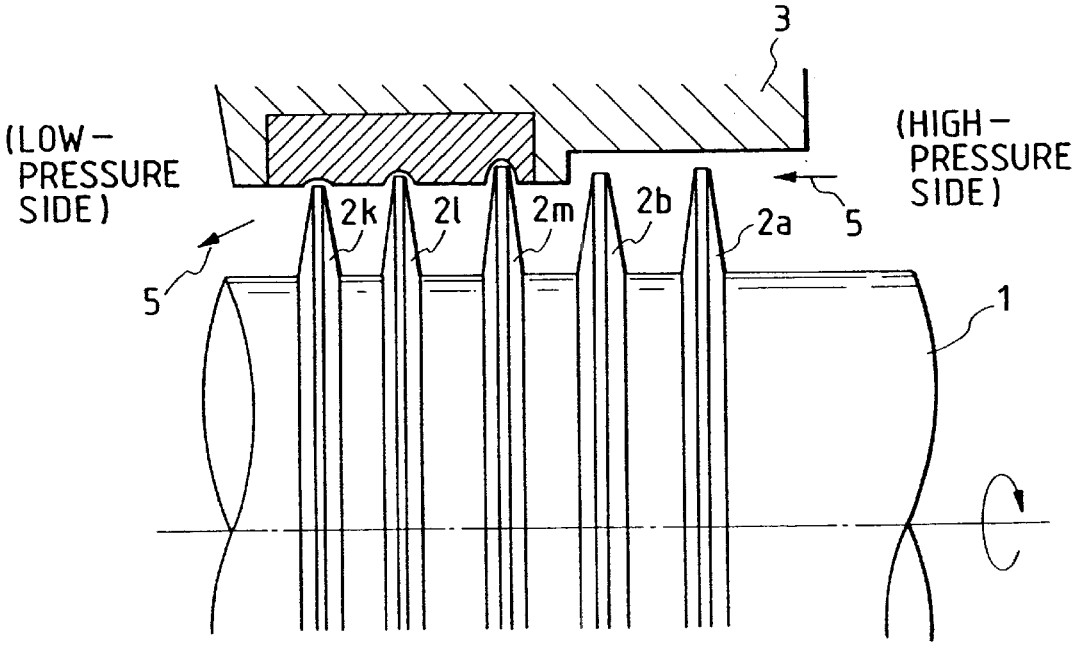
FIG. 5 is a vertical sectional view of the other embodiment of the labyrinth sealing device according to the present invention, showing the running state of the fluid machine.

FIGS. 4 and 5 are the detailed vertical sectional views of a labyrinth sealing portion according to another embodiment of the present invention. Herein, FIG. 4 illustrates the stationary state of a fluid machine, while FIG. 5 illustrates the running state thereof. The point of difference of this embodiment from the foregoing embodiment shown in FIGS. 1 and 2 is that distal-end gaps $\delta_{1k}$, $\delta_{1l}$, $\delta_{1m}$, which are defined between a layer of abradable coating to-be-bitten 4 provided in an inner casing 3 and fins 2*k*, 2*l*, 2*m* opposing to the coating layer 4 change in the axial direction of the labyrinth sealing portion. Owing to such a construction, these fins 2*k*, 2*l*, 2*m* do not simultaneously touch the layer of abradable coating to-be-bitten 4 for a time period in which a rotary shaft 1 having started its rotation reaches a predetermined value of r. p. m. In other words, even in the running of the fluid machine where all the fins 2*k*, 2*l*, 2*m* come into contact with the coating layer 4, they touch the coating layer 4 at time intervals one by one. Therefore, impacts ascribable to the touches can be suppressed to low levels, and bearings etc. are not damaged. It is consequently possible to provide a labyrinth seal whose reliability is high and which is greatly effective to suppress leakage. Incidentally, fins 2*a*, 2*b* are formed in order to attain a certain degree of labyrinth sealing effect and to attain a labyrinth sealing effect even when the layer of abradable coating to-be-bitten 4 has peeled off or chipped off due to a shock, corrosion or the like.

Figure 6:
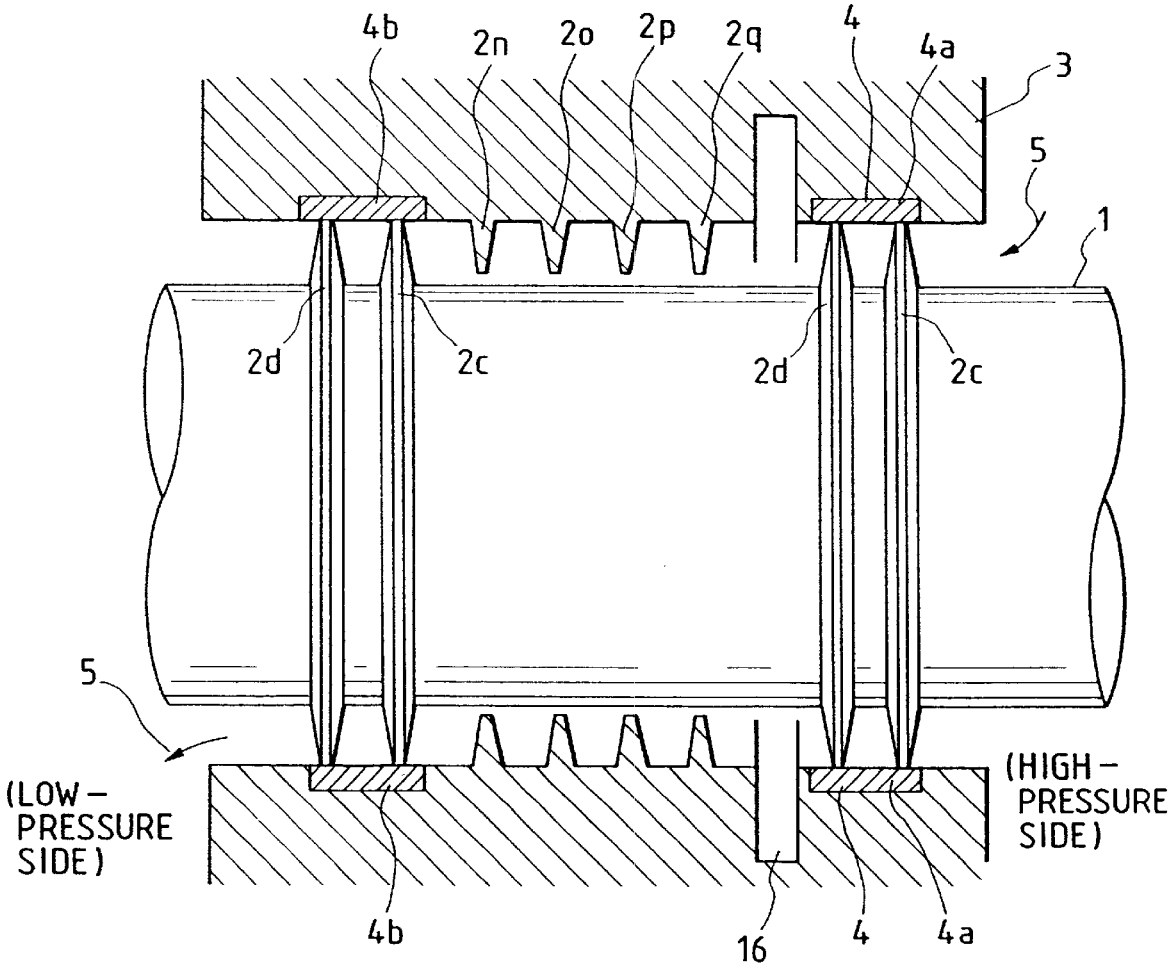
FIG. 6 is a vertical sectional view of still another embodiment of a labyrinth sealing device according to the present invention.

FIG. 6 is the detailed vertical sectional view of a labyrinth sealing portion according to still another embodiment of the present invention. This embodiment offers a method which is effective when the difference between the pressures of a working fluid at the inlet and outlet of a labyrinth seal is great. By way of example, the labyrinth seal is applied to the portion of the balance piston 15. The point of difference of this embodiment from the foregoing embodiment shown in FIGS. 1 and 2 is that layers of abradable coating to.-be-bitten 4 are disposed in two separate places 4*a*, 4*b* in the axial direction of the labyrinth sealing portion, and a groove 16 is formed between the coating layers 4. Further, in this embodiment, an increased number of fins are formed on a rotary shaft 1 as indicated by fins 2*c*, 2*d* with respect to any other embodiment, thereby further enhancing the effect of suppressing a leakage stream.

The fins of this sort, however, are not very effective even when the number of them is merely increased, for the following reasons: Impacts ascribable to the touches of the fins with the coating layers increase in accordance with the number of the fins. Besides, bitten-off powder which has appeared due to the touches of the upstream-side fins might be laid into the downstream-side touch parts to widen the distal-end gaps of the downstream-side fins. It is consequently apprehended, not only that the sealing effect of the labyrinth sealing portion will not be attained in correspondence with the number of the fins, but also that it will even lower than previously achieved.

In this embodiment, the groove 16 being comparatively deep is provided downstream of the abradable coating to-be-bitten 4*a*. Thus, large and heavy powder particles in the bitten-off powder taken away from the abradable coating to-be-bitten 4*a* are accumulated in the groove 16 and are prevented from flowing out downstream. As a result, the dust of the abradable coating to-be-bitten 4*a* located on the upstream side does not flow into the abradable coating to-be-bitten 4*b* located on the downstream side. In short, the abradable coating layers to-be-bitten of equal sealing performances are formed in the two places, and a higher sealing effect is attained.

In any of the above embodiments, the abradable coating to-be-bitten may be made of any of a nickel-graphite-based coating material, an aluminum-silicon-polyester-based coating material, white metal, etc. In addition, although the multistage centrifugal compressor has been taken as one example, the present invention is applicable to various machines, such as a single-stage centrifugal compressor, a multistage centrifugal pump and a single-stage centrifugal pump, within a scope not departing from the purport of the present invention. Further, the several embodiments of the present invention as mentioned before are merely exemplary and are never restrictive. The scope of the present invention is clearly defined by the appended claims, and modifications existing within the true spirit and scope of the present invention shall be all covered in the present invention.

According to the present invention, for example, ordinary fins and fins which oppose to abradable coating to-be-bitten are used. It is therefore possible to provide a labyrinth sealing device which greatly reduces the rate of leakage flow, and a fluid machine which employs the labyrinth sealing device. It is also possible to provide a labyrinth sealing device whose sealing performance degrades slightly even when the portion of the abradable coating to-be-bitten has damaged or peeled off due to corrosion or the like, and a fluid machine which employs the labyrinth sealing device.

Moreover, according to the present invention, it is possible to provide shaft sealing means which suffers from a slight loss ascribable to leakage in the ordinary use thereof and whose sealing performance degrades slightly even in case of the occurrence of any trouble, and a fluid machine which includes the shaft sealing means.

Further, a resistance at the touch of a fin can be reduced. As a result, it is possible to provide a labyrinth sealing device of very high reliability in which vibrations are suppressed to low levels, and a fluid machine which includes the improved labyrinth sealing device.

What is claimed is:

1. A labyrinth sealing device having an impeller and a casing, one of which is provided with a plurality of labyrinth fins, wherein a clearance which at least one of the labyrinth fins defines with respect to a respective opposing part of either of the impeller and the casing is set smaller than a clearance which any other of the labyrinth fins defines, with respect to respective opposing parts of said either of the impeller and the casing, and wherein said either of said impeller and said casing has an abradable coating at the opposing part to the at least one labyrinth fin of the smaller clearance.

2. A labyrinth sealing device as defined in claim 1, wherein each of said plurality of labyrinth fins is perpendicular to said impeller and is continuous in a circumferential direction thereof.

3. A labyrinth sealing device as defined in claim 1, wherein each of said plurality of labyrinth fins is wider at a respective base than at a respective distal end.

4. A labyrinth sealing device as defined in claim 1, wherein the abradable coating is one selected from the group consisting of flame spraying of a nickel-graphite-based coating material, flame spraying of an aluminum-silicon-polyester-based coating material, and coating with white metal.

* * * * *